US007844071B2

(12) United States Patent
Funahashi et al.

(10) Patent No.: US 7,844,071 B2
(45) Date of Patent: Nov. 30, 2010

(54) LOUDSPEAKER

(75) Inventors: Osamu Funahashi, Osaka (JP); Seiichi Yoshida, Osaka (JP); Kimihiro Ando, Mie (JP); Kazuyoshi Umemura, Mie (JP)

(73) Assignee: Panasonic Corporation, Osaka (JP)

( * ) Notice: Subject to any disclaimer, the term of this patent is extended or adjusted under 35 U.S.C. 154(b) by 231 days.

(21) Appl. No.: 10/583,044

(22) PCT Filed: Nov. 18, 2005

(86) PCT No.: PCT/JP2005/021229

§ 371 (c)(1),
(2), (4) Date: Jun. 15, 2006

(87) PCT Pub. No.: WO2006/064630

PCT Pub. Date: Jun. 22, 2006

(65) Prior Publication Data

US 2007/0177757 A1 Aug. 2, 2007

(30) Foreign Application Priority Data

Dec. 14, 2004 (JP) ..... 2004-361168

(51) Int. Cl.
*H04R 1/00* (2006.01)

(52) U.S. Cl. ..... 381/403; 381/396; 381/404; 381/407

(58) Field of Classification Search ..... 381/386, 381/398, 400, 403–404, 396, 407
See application file for complete search history.

(56) References Cited

U.S. PATENT DOCUMENTS 4,118,605 A 10/1978 Kobayashi
4,188,605 A * 2/1980 Stout ..... 338/32 H
6,088,466 A * 7/2000 Proni ..... 381/397
6,118,884 A * 9/2000 Proni ..... 381/403
6,327,371 B1 * 12/2001 Proni ..... 381/397
6,490,363 B1 * 12/2002 Liu ..... 381/403

(Continued)

FOREIGN PATENT DOCUMENTS

EP 1233644 A2 * 8/2002

(Continued)

OTHER PUBLICATIONS

Suzuki, Takashi; "Surround for speaker system and manufacturing method thereof"; Nov. 2005; J. Acoust. Soc. Am. 118 (5); p. 2759.*

(Continued)

*Primary Examiner*—Curtis Kuntz
*Assistant Examiner*—Ryan Robinson
(74) *Attorney, Agent, or Firm*—RatnerPrestia

(57) ABSTRACT

Voice coil body of a loudspeaker is provided at the outer circumferential wall surface with a supporting section. Diameter of the inner circumference of suspension holder is greater than outer diameter of the voice coil body while diameter of the inner circumference of diaphragm is greater than diameter of the inner circumference of suspension holder for facilitating a gluing of the inner circumferential end of suspension holder and the inner circumferential end of diaphragm on the supporting section and to the voice coil body. By so doing, harmonic distortion of a loudspeaker can be further reduced.

3 Claims, 2 Drawing Sheets

U.S. PATENT DOCUMENTS

| | | | | |
|---|---|---|---|---|
| 6,501,844 | B2 * | 12/2002 | Proni | 381/403 |
| 6,836,551 | B2 | 12/2004 | Kuze et al. | |
| 6,842,529 | B2 | 1/2005 | Koura et al. | |
| 7,010,141 | B2 * | 3/2006 | Sugiura et al. | 381/404 |
| 7,185,735 | B2 * | 3/2007 | Sahyoun | 181/157 |
| 7,263,198 | B2 * | 8/2007 | Onuma | 381/403 |
| 7,394,913 | B2 * | 7/2008 | Matsuda et al. | 381/400 |
| 7,760,901 | B2 * | 7/2010 | Kaiya et al. | 381/404 |
| 2003/0185415 | A1 * | 10/2003 | Funahashi et al. | 381/398 |
| 2004/0165746 | A1 * | 8/2004 | Kreitmeier et al. | 381/398 |
| 2005/0099255 | A1 * | 5/2005 | Zhang | 335/251 |
| 2005/0111690 | A1 * | 5/2005 | Onuma et al. | 381/424 |
| 2007/0223775 | A1 * | 9/2007 | Sugiura | 381/407 |

FOREIGN PATENT DOCUMENTS

| | | |
|---|---|---|
| JP | 36-012804 | 5/1961 |
| JP | 36-009007 | 6/1961 |
| JP | 48-096941 | 11/1973 |
| JP | 58-147395 | 10/1983 |
| JP | 02-120997 | 10/1990 |
| JP | 2004-007332 | 1/2004 |

OTHER PUBLICATIONS

International Search Report for application No. PCT/JP2005/021229 dated Mar. 14, 2006.
English translation of Form PCT/ISA/210.

* cited by examiner

LOUDSPEAKER

This Application is a U.S. National Phase Application of PCT International Application PCT/JP2005/021229.

TECHNICAL FIELD

The present invention relates to a loudspeaker.

BACKGROUND ART

As shown in FIG. 3, a conventional loudspeaker includes voice coil body 2, which is disposed so as it can move freely in magnetic circuit 1 and connected with diaphragm 3 at the inner circumferential end. The outer circumferential end of diaphragm 3 is fixed to frame 5 via edge 4, while the reverse surface of diaphragm 3 is connected to frame 5 via suspension holder 6 and edge 7. Reduction of harmonic distortion and improvement in the linear characteristics of a loudspeaker has been contrived by making use of a symmetric status of edge 4 and edge 7. Japanese Patent Unexamined Publication No. 2004-7332 discloses a loudspeaker of the above-described structure.

In fabricating a loudspeaker of the above structure, diaphragm 3 is set to a position by having the inner circumferential end of diaphragm 3 to make contact with voice coil body 2's outer wall surface, and the two items are glued together in this state. Therefore, a stress due to the mutual contact can not help affecting a deflection state of edge 4 locating at the outer circumference of diaphragm. So, it is difficult to provide an initial symmetry with edge 4 and edge 7. Therefore, suppressing completely the harmonic distortion of a loudspeaker remains as an outstanding problem.

SUMMARY OF THE INVENTION

Voice coil body, which is a constituent member of a loudspeaker, is provided at the outer wall surface with a supporting section protruding outward. For facilitating an operation of gluing both the inner circumferential end of suspension holder and the inner circumferential end of diaphragm to the supporting section and to the voice coil body, the diameter of suspension holder's inner circumference is made to be greater than the diameter of voice coil body's outer circumference while the diameter of diaphragm's inner circumference is made to be greater than the diameter of suspension holder's inner circumference. When assembling a diaphragm and a suspension holder with the above-configured voice coil body, the inner circumferential end of suspension holder is placed on the supporting section and the inner circumferential end of diaphragm is placed on the suspension holder. In this state, they are aligned to their respective right locations, and glued together. So, there is no stress force due to an aligning operation which effects in the direction towards the edge. A status of the deflected edges is least affected, therefore the harmonic distortion of a loudspeaker can be reduced.

REFERENCE MARKS IN THE DRAWINGS

Figure 1:
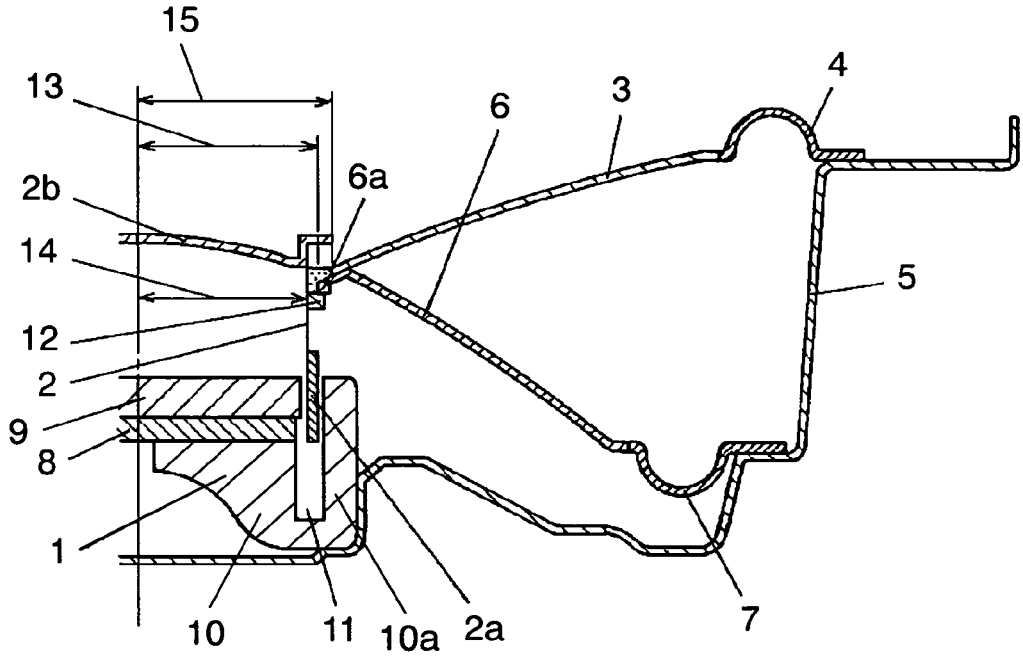
FIG. 1 is a cross sectional view in part of a loudspeaker in accordance with an exemplary embodiment of the present invention.

1 Magnetic Circuit
2 Voice Coil Body
3 Diaphragm
4 First Edge
5 Frame
6 Suspension Holder
7 Second Edge
11 Magnetic Gap
12 Supporting Section

DETAILED DESCRIPTION OF PREFERRED EMBODIMENT

An exemplary embodiment of the present invention is described referring to the drawings. The drawings are intended to show the concept of invention; so, they may not necessarily represent relative positioning among the constituent members and their dimensions precisely. Those portions identical to those described in the background art are identified by indicating them with the same symbols.

Exemplary Embodiment

Reference is made to FIG. 1. Magnetic circuit 1 is formed by an integration of magnet 8, plate 9 and yoke 10, and disposed at the central bottom of frame 5 made of an iron sheet. Magnetic gap 11 which is an upward opening of magnetic circuit 1 is constituted by the inner wall surface 10*a* of yoke 10 and the outer side-walls of magnet 8 and plate 9.

Voice coil body 2 is a cylindrical body which is wound around with coil 2*a*, and disposed in magnetic gap 11 in a manner it can move up and down freely in there. Voice coil body 2 vibrates diaphragm 3 fixed to the circumferential surface of voice coil body in the upper part. As an anti-dust means, voice coil body 2 is provided at the top end with dust cap 2*b*.

The outer circumferential end of diaphragm 3 is fixed to the open end of frame 5 via first edge 4, while the inner circumferential end is supported by suspension holder 6.

Suspension holder 6 is fixed at the outer circumferential end to the bottom part of frame 5 via second edge 7, while the inner circumferential end is glued to be integrated with the reverse surface of diaphragm 3's inner circumferential area. Provided at the inner circumferential part of suspension holder 6 is neck 6*a*, which neck is bent downward to be going along the outer surface of voice coil body 2. A point at which voice coil body 2, diaphragm 3 and suspension holder 6 are connected together, which point being the point of driving voice coil body 2, resides within a region surrounded with first edge 4 and second edge 7 both connected to frame 5. Therefore, diaphragm 3, suspension holder 6 and voice coil body 2 can be regarded as forming a rigid body. Thus, rolling motion of voice coil body 2 can be suppressed while diaphragm 3 is allowed to move freely, and it can attenuate the harmonic content.

Figure 2:
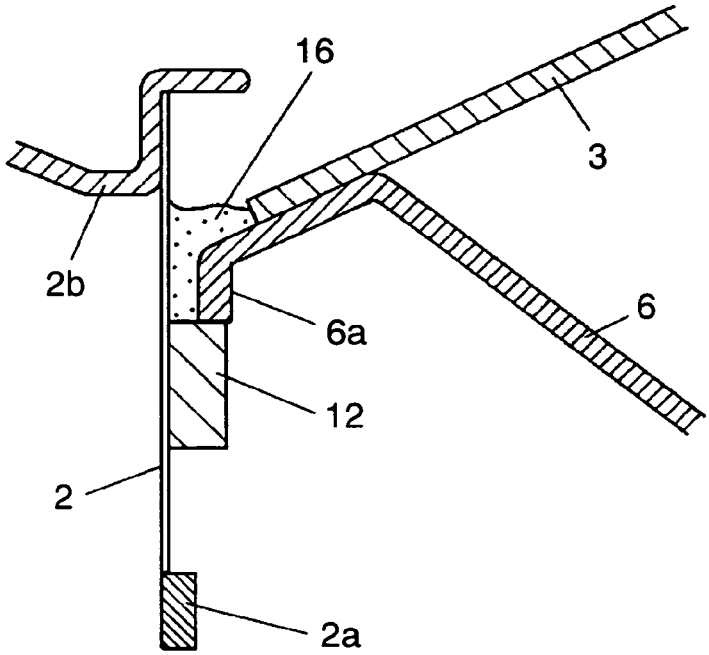
FIG. 2 illustrates details in the neighborhood of the supporting section of the loudspeaker of FIG. 1.
Figure 3:
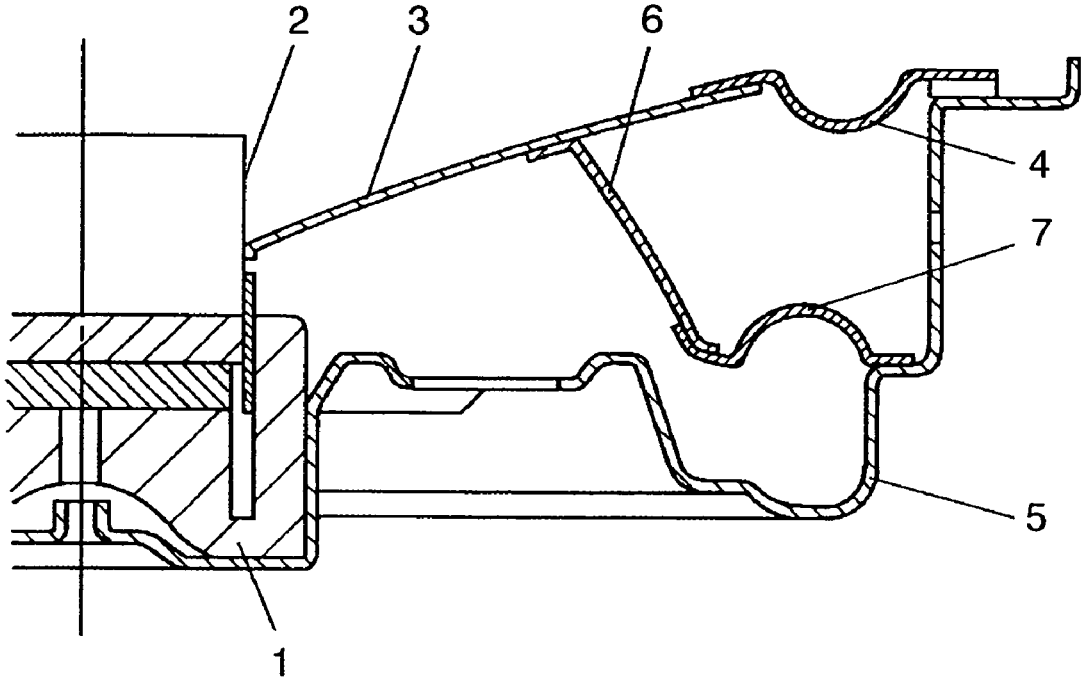
FIG. 3 PRIOR ART
FIG. 3 is a cross sectional view in part of a conventional loudspeaker.

Now, reference is made to FIG. 2. Voice coil body 2 is provided at the outer wall surface with supporting section 12 protruding outward. Suspension holder 6 is glued and fixed on supporting section 12 as well as to the outer surface of voice coil body 2, and the inner circumferential end of diaphragm 3 is glued and fixed on the upper surface of suspension holder 6. Inner diameter 13 of suspension holder 6 is greater than voice coil body 2's outer diameter 14, inner diameter 15 of diaphragm 3 is greater than suspension holder 6's inner diameter 13.

In placing the above-configured diaphragm 3 and suspension holder 6 in relation to voice coil body 2, suspension holder 6 and diaphragm 3 can aligned to the right position while they are resting on supporting section 12 without the inner end of circumferential part of suspension holder 6 and diaphragm 3 making any contact to the outer surface of voice coil body 2, since inner diameter 13 of diaphragm 3 and suspension holder 6 is greater than outer diameter 14 of voice coil body 2 at the connecting portion. Thus, the outstanding problem, namely, a stress caused by an aligning operation influencing onto the deflection status of first edge 4 and second edge 7, can be improved for reduction of harmonic distortion with a loudspeaker.

Now in the following, description is made on a procedure of gluing and fixing suspension holder 6 and diaphragm 3 to voice coil body 2. First, put voice coil body 2 in magnetic circuit 1 using a jig and keep it as it is in there. In this state, place neck 6*a* of suspension holder 6, which suspension holder has been fixed and glued to frame 5 via second edge 7, on the upper surface of voice coil body 2's supporting section 12. Align suspension holder 6 disposed on supporting section 12 to a right place relative to voice coil body 2, and glue and fix neck 6*a* on the upper surface of supporting section 12 as well as to the outer wall surface of voice coil body 2. And then, glue and fix the inner circumferential end of diaphragm 3, which diaphragm has been fixed and glued to frame 5 via first edge 4, on the upper surface of suspension holder 6. For the purpose of gluing neck 6*a* with supporting section 12 as well as diaphragm 3 with suspension holder 6, apply adhesive agent 16 which is primarily intended for gluing neck 6*a* with supporting section 12 in such a manner that it spreads to reach also an upper area of suspension holder 6. Diaphragm 3 is placed from above suspension holder 6 and glued thereon by making use of adhesive agent 16 thus applied, which is creeping up to the upper surface of suspension holder 6. When the mount of adhesive agent 16 is too much, superfluous adhesive agent 16 tends to stay above neck 6*a* in the neighborhood of outer wall surface of voice coil body 2, or the area around the inner circumferential end of suspension holder 6. If diaphragm 3 is disposed on the staying adhesive agent 16, the inner circumferential end portion of diaphragm 3 is lifted up by the redundant adhesive. The lift-up diaphragm 3 would ill-affect the sound characteristics of a loudspeaker. In order to avoid this to happen, it is important to make inner diameter 15 of diaphragm 3 to be greater than inner diameter 13 of suspension holder 6, for preventing the lift-up phenomenon at the inner circumference of diaphragm 3 caused by the superfluous adhesive agent.

Furthermore, supporting section 12 of voice coil body 2 brings about following advantage in the process of gluing with suspension holder 6. Besides the function described earlier, supporting section 12 also functions as a dam to prevent adhesive agent 16 from dripping to the coil sector through a narrow gap between voice coil body 2 and neck 6*a*. It works to reduce the rejects due to inappropriate gluing during assembly operation. Thus, it contributes to a higher productivity in the manufacturing of loudspeakers.

The present invention can be implemented using those constituent materials already-known.

INDUSTRIAL APPLICABILITY

The present invention is applicable to the manufacturing of those speakers which need further improvement in the harmonic distortion. More specifically, high-input car-borne type speakers, among other types, would enjoy significant advantages of the present invention.

The invention claimed is:

1. A loudspeaker comprising a frame, a magnetic circuit held by the frame, a voice coil body disposed so as it can move freely in a magnetic gap of the magnetic circuit, a diaphragm whose outer circumferential end is connected to the frame via a first edge, and a suspension holder whose outer circumferential end is connected to the frame via a second edge; and a supporting section attached to the voice coil body, wherein:

a diameter of an inner circumference of the suspension holder is greater than an outer diameter of the voice coil body while a diameter of an inner circumference of the diaphragm is greater than the diameter of the inner circumference of the suspension holder, the suspension holder has an inner circumferential portion which is spaced apart from the voice coil body, an innermost surface of the inner circumferential portion is disposed on a top surface of the supporting section and is coupled to the voice coil body via only an adhesive, and the diaphragm is disposed on and in contact with the suspension holder at an inner circumferential end of the suspension holder such that the diaphragm is supported by the suspension holder.

2. A loudspeaker comprising:

a frame, a magnetic circuit held by the frame, a voice coil body disposed so as it can move freely in a magnetic gap of the magnetic circuit, a diaphragm whose outer circumferential end is connected to the frame via a first edge, and a suspension holder whose outer circumferential end is connected to the frame via a second edge; and a cylindrical supporting section attached to the voice coil body, wherein:

a diameter of an inner circumference of the suspension holder is greater than an outer diameter of the voice coil body while a diameter of an inner circumference of the diaphragm is greater than the diameter of the inner circumference of the suspension holder, the suspension holder has an inner circumferential portion which is spaced apart from the voice coil body, an innermost surface of the inner circumferential portion is disposed on a top surface of the supporting section extending out from the voice coil body, the inner circumferential portion directly coupled to the voice coil body via an adhesive, and the diaphragm is disposed on and in contact with the suspension holder at an inner circumferential end of the suspension holder such that the diaphragm is supported by the suspension holder.

3. A loudspeaker comprising:

a frame, a magnetic circuit held by the frame, a voice coil body disposed so as it can move freely in a magnetic gap of the magnetic circuit, a diaphragm whose outer circumferential end is connected to the frame via a first edge, and a suspension holder whose outer circumferential end is connected to the frame via a second edge; and a supporting section attached to the voice coil body, wherein:

a diameter of an inner circumference of the suspension holder is greater than an outer diameter of the voice coil body while a diameter of an inner circumference of the diaphragm is greater than the diameter of the inner circumference of the suspension holder, the suspension holder has an inner circumferential portion which is spaced apart from the voice coil body, the inner circumferential portion is disposed on a top surface of the supporting section extending out from the voice coil body, the inner circumferential portion directly coupled via an adhesive to the voice coil body, the inner circumferential portion extending upwardly from the top surface of the supporting section, and the diaphragm is disposed on and in contact with the suspension holder at an inner circumferential end of the suspension holder such that the diaphragm is supported by the suspension holder.

* * * * *